United States Patent [19]

Mudd et al.

[11] Patent Number: 4,575,336

[45] Date of Patent: Mar. 11, 1986

[54] APPARATUS FOR TREATING OIL FIELD WASTES CONTAINING HYDROCARBONS

[75] Inventors: Robert E. Mudd; Wendell L. Wyatt, both of Cameron, La.

[73] Assignee: Eco Industries, Inc., Waco, Tex.

[21] Appl. No.: 517,113

[22] Filed: Jul. 25, 1983

[51] Int. Cl.[4] ..... F23G 7/04; F23G 5/06; F23J 11/00

[52] U.S. Cl. ..... 432/72; 110/238; 110/246

[58] Field of Search ..... 432/72; 110/236, 238, 110/246; 252/8.5 M

[56] References Cited

U.S. PATENT DOCUMENTS

| | | | |
|---|---|---|---|
| 3,658,015 | 4/1972 | Griffin et al. | 126/360 X |
| 4,139,462 | 2/1979 | Sample, Jr. | 210/72 |
| 4,209,381 | 6/1980 | Kelly, Jr. | 208/8 LE |
| 4,222,988 | 9/1980 | Barthel | 422/309 |
| 4,245,571 | 1/1981 | Przewalski | 110/246 |
| 4,431,405 | 2/1984 | Eatherton | 432/72 |
| 4,475,466 | 10/1984 | Gravely | 110/238 |

*Primary Examiner*—John J. Camby

*Attorney, Agent, or Firm*—Kanz, Scherback & Timmons

[57] ABSTRACT

A method and apparatus of treating oil field wastes and particularly spent drilling fluids which contain barite and hydrocarbons which includes placing the drilling fluids into the upper end of a downwardly directed rotating kiln. Fuel and pressurized air are inserted into a furnace connected to the upper end of the kiln for supplying a fire to the drilling fluids in the kiln for igniting and burning the hydrocarbons in the drilling fluids as fuel until the drilling fluid is dry. The high weight impurities are separated from the dried drilling fluid by gravity from the kiln and the light weight fines and more valuable components including the barite are removed from the kiln by suction. The more valuable components are mixed with new components for providing a recycled drilling fluid. The gases separated from the light weight dry drilling fluids are washed to remove any pollutants before exhaustion to the atmosphere. The particulates cleaned from the gases may be recycled to the kiln. The present apparatus and method uses the hydrocarbons in the drilling fluid as a source of fuel, recovers valuable constituents of the drilling fluid, such as barite and clay which can be recycled into new drilling fluids, and produces a residue that is environmentally safe.

5 Claims, 3 Drawing Figures

APPARATUS FOR TREATING OIL FIELD WASTES CONTAINING HYDROCARBONS

BACKGROUND OF THE INVENTION

Various oil field wastes contain hydrocarbons. However, various state and federal laws and regulations require that these wastes be properly disposed of. The disposal problem has been considerable and expensive. For example, it is conventional in rotary drilling oil and gas wells to use a drilling fluid commonly called "mud". The drilling fluid performs various important functions as it is circulated downwardly through a drill pipe, out a drill bit and up the borehole to the surface. The drilling fluids commonly are of an oil base. In addition, the drilling fluids and the well cuttings may be exposed to hydrocarbons and other pollutants in the well bore.

Various methods and apparatus have been proposed to treat these oil field wastes in order to make them ecologically acceptable such as disclosed in U.S. Pat. Nos. 3,658,105; 4,209,381; 4,222,988; and 4,139,462. However, the problem of meeting all of the restrictions of governmental authorities and properly disposing of these oil field wastes has continued to be a difficult and expensive operation. The present invention is directed to improved methods and apparatus for treating oil field wastes and particularly spent drilling fluids and cuttings which contain hydrocarbons. The process utilizes the hydrocarbons in the oil field wastes as a source of fuel for burning the wastes to provide a pollution free residue and to recover and recycle the constituents. The process thus avoids the disposal problem and provides products for resale thereby reducing the cost of the treating process.

SUMMARY

The present invention is directed to a method and apparatus for treating oil field wastes containing hydrocarbons, and particularly to the treatment of spent oil base drilling fluids and drill cuttings. More particularly, the present invention involves the treatment and disposal of wastes conaining carbonanceous materials by igniting the wastes in a rotary kiln and burning the wastes using the carbonaceous materials in the wastes as fuel. The wastes are dried and separated from the hydrocarbons, thereby not only producing a residue which is pollution free, but utilizing the waste product to provide part of the fuel for its own treatment. A particular advantage of the present invention is the provision of methods and apparatus for recycling spent oil field drilling fluids containing valuable constituents such as barite and clays and in which the valuable constituents are recovered from less valuable constituents and recycled to make a usable product, thus not only avoiding the problem of disposal of polluted products, but decreasing the overall costs of processing and disposing of the original wastes.

Generally, the invention comprises a method and apparatus for recycling used oil field drilling fluids containing barite and hydrocarbons wherein the used drilling fluids are placed in the upper end of a downwardly directed rotating kiln and fuel and air inserted into the kiln at the same end of the kiln at which the drilling fluids are inserted. The fuel and air aids in starting and maintaining combustion of the hydrocarbons in the fluid until the drilling fluid is dried and materially aids in reducing the risk of uncontrolled explosion of the hydrocarbons in the drilling fluid during such drying.

The invention further includes the unique step of separating high weight solid components from the more valuable low weight components and recovering the more valuable low weight components such as barite and clays. The separated and recovered more valuable components are mixed with additional drilling fluid components for providing a recycled drilling fluid. The higher weight components are pollution free and may be utilized and sold for other uses such as landfill. Gases are removed from the dried product and are cleaned such as by spraying with water for cleaning the gases exhausted to the atmosphere thereby providing an entirely pollution free process.

Other features and advantages will be apparent from the following description of a presently preferred embodiment of the invention, given for the purpose of disclosure and taken in conjunction with the accompanying drawings.

DESCRIPTION OF THE PREFERRED EMBODIMENT

Drilling fluids used in rotary drilling oil and gas wells perform various important functions. The major constituent of a drilling fluid is barite, which adds weight to the mixture. Other components may include oil, water, clays and various chemical additives which perform various functions such as corrosion control, lubrication and viscosity control. However, the disposal of oil base spent drilling fluids and drill cuttings has created costly disposal problems and pollution problems with possible consequent liabilities many years later. The present method and apparatus provides a way for treating and disposing of the oil field waste which contain hydrocarbons to convert them into a pollution free product. In addition, the present method and apparatus reclaims the constituents from the spent drilling fluids thereby not only eliminating costly disposal expenditures but permitting recycling of the spent drilling fluids.

The major component of drilling mud is barium sulfate ($BaSO_4$), commonly known as "Barite". The specific gravity of barite is between generally about 4.3 to about 4.6. The present method and apparatus recovers and recycles the barite and clays in the spent drilling fluid and provides a valuable recycled drilling fluid. In addition, the other components of the drilling fluids are rendered pollution free and, while less valuable, can be sold for other uses.

Figure 1:
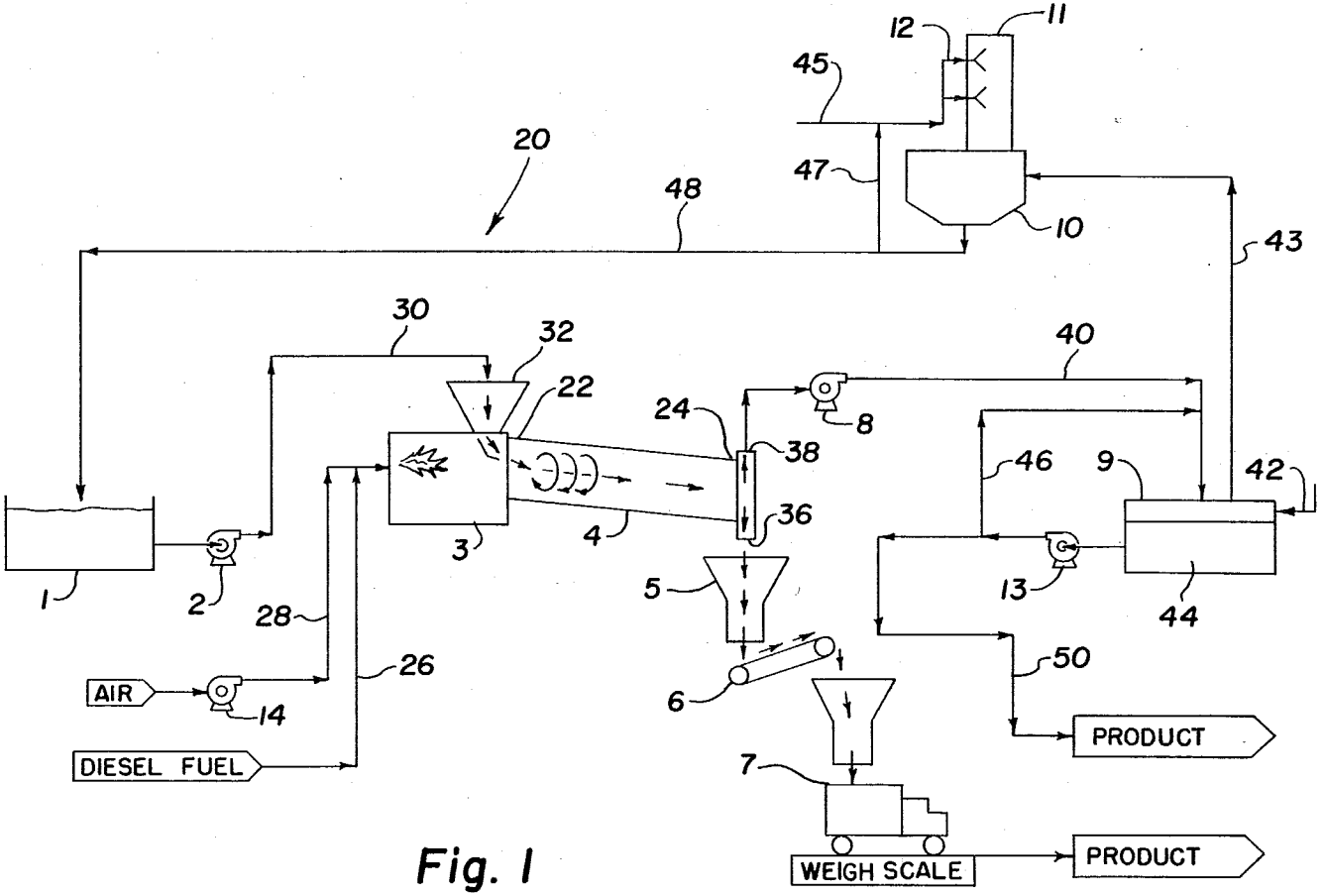
FIG. 1 is a schematic flow diagram of the present invention with valves omitted for convenience.

Referring now to the drawings, and particularly to FIG. 1, apparatus suitable for practicing the present invention is generally indicated by the reference numeral 20. A holding tank 1 is provided for receiving oil field wastes such as spent oil base drilling fluids which are stored in preparation for processing. The spent drilling fluids may include oil, barite, trash, water, sand, shale and various chemicals. A rotary kiln or drier 4 is provided for receiving the spent drilling fluids in which the drilling fluid is burned sufficiently to oxidize the hydrocarbons and reduce the residue to a non-polluting form. In order to initiate the combustion of the drilling fluids while in the rotary kiln 4, a horizontal furnace 3 is provided at a first or inlet end 22 of the kiln 4. The first end 22 is preferably at a higher elevation than the second end 24 of the kiln 4. The furnace 3 is equipped with a burner such as a conventional John Zink burner and utilizes a suitable fuel, such as diesel, supplied by line 26 to the inlet of the furnance 3. Air for combustion is supplied by an air blower 14 to a line 28 to the inlet of the furnace 3. The furnace 3 is used to initiate the combustion of the drilling fluids in the kiln 30 and to aid the combustion of the drilling fluid if needed. After start-up, the hydrocarbon content of the spent drilling fluid is generally sufficient to support combustion thereby saving fuel as well as disposing of the undesirable components in the drilling fluid.

The drilling fluids are conveyed to the kiln 4 from the holding tank 1 by any suitable means such as a slurry pump 2 which withdraws the stored drilling fluids from the tank 1 through a line 30 to a chute 32 above the heater 3 to deposit the spent drilling fluids into the first end 22 of the kiln 4.

Figures 2, 3:
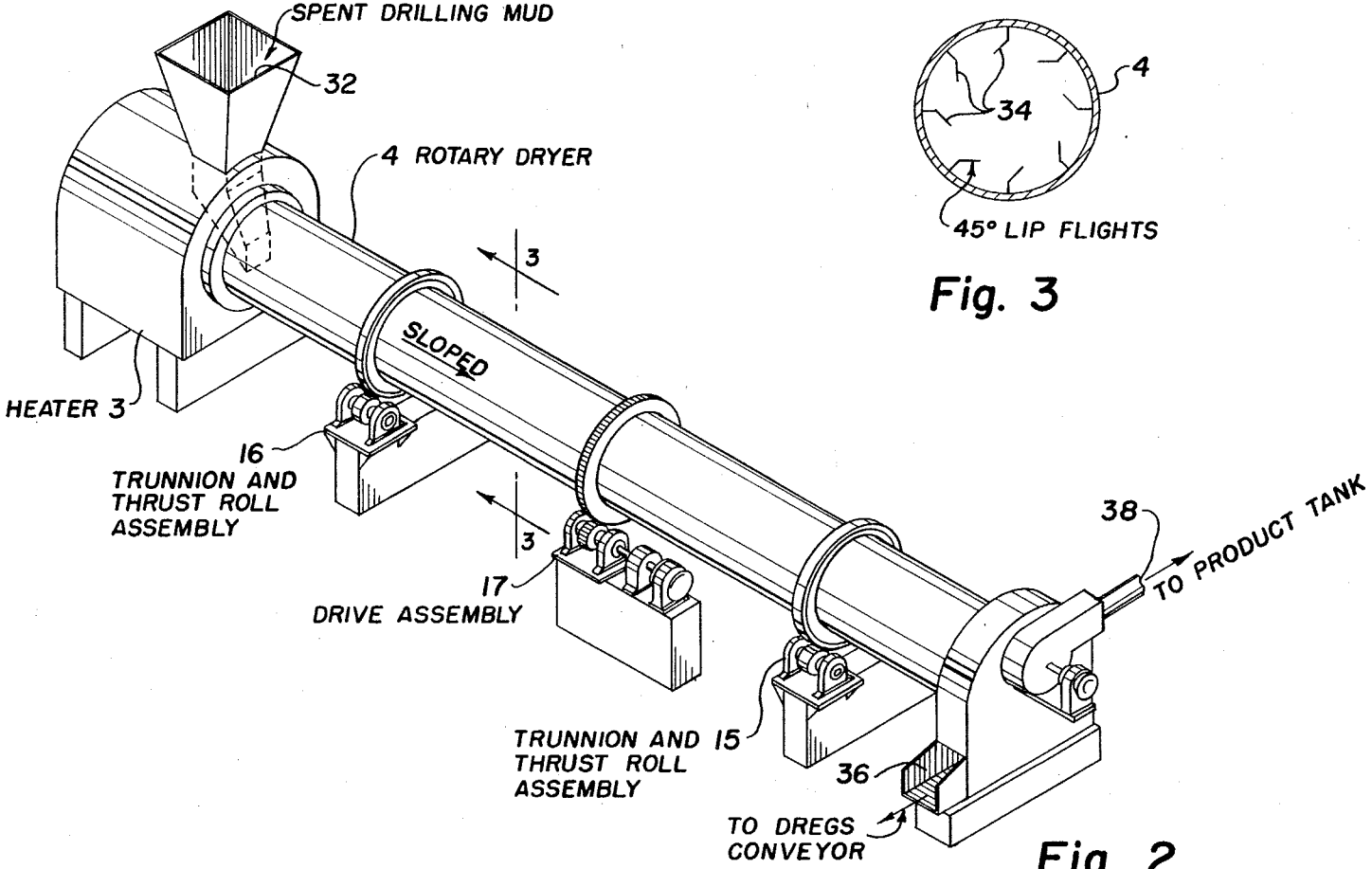
FIG. 2 is an enlarged perspective view of the rotating kiln of the present invention.
FIG. 3 is a cross section taken along the rotary kiln of FIG. 2.

The kiln 4 rotates on trunnion and thrust rolls 15 and 16, as best seen in FIG. 2, and is rotated by a drive assembly 17. The kiln 4 also includes internally, as best seen in FIG. 3, a plurality of helical lip flights 34 preferably positioned at approximately 45° for mixing the burning drilling fluid, providing a greater heat transfer surface and better control of temperature as the fluids move from the higher elevation inlet end 22 of the kiln to the lower elevation outlet end 24 of the kiln 4. In one embodiment, the kiln is about 6′ 4″ (1.93 meters) in diameter and 60 feet (18 meters) long.

It should be noted that both the processed drilling fluids and the heated gases from the furnace 3 flow the same direction through the kiln 4 to provide concurrent flow. This insures that all of the burnable material in the incoming spent drilling fluids is immediately exposed to flame when it enters the first end 22 and is ignited as it encounters the flame. By immediately igniting the incoming fluid, the possibility of an explosion is reduced or eliminated. A countercurrent flow of heat relative to the flow of drilling fluids would tend to generate a volume of explosive gases in the kiln 4 and cause the possibility of dangerous explosion. While the temperatures provided in the kiln 4 are not critical, it is preferable that the temperature of the kiln 4 at the inlet end 22 be approximately 1500° F. and be approximately 400° F. at the outlet end 24. In any event, the temperature created in the kiln 4 is sufficient to burn all of the hydrocarbons in the wastes but not sufficient to melt the barite. The materials should be sufficiently heated to reduce the barite and clays in the drilling fluids to a fine powder. Combustible materials are fully oxidized but non-combustibles, such as drill bit pieces, shells, sand and shale and so forth, are conveyed to the outlet end 24 of the kiln 4. The outlet end 24 of the kiln 4 includes a lower outlet 36 through which the heavier materials may fall by gravity into a hopper 5 which feeds a bucket elevator 6 which conveys the higher weight residues to a truck 7. These higher weight residues, which are now pollution free, may be sold for various uses, such as landfill. An outlet 38 is connected to a suction blower 8 whereby the fines which includes the barite and clays are conveyed to a product tank 9 along with any gases from the kiln 4. Accordingly, the untreated gases do not escape to and pollute the atmosphere. Using the process and apparatus described, as much as 80% or more of the barite in the incoming drilling fluids may be recovered.

The product tank 9 includes an inlet 42 for adding new drilling mud components to mix with the barite and clays flowing into the tank 9 through the line 40. The recycled barite and clays mix with the material 44 in the tank 9. The gaseous effluent, which consists mainly of carbon dioxide but also contains some particulates, flows through a line 43 from tank 9 to an impinger tank 10 having a chimney stack 11 exposed to the atmosphere but which is equipped with one or more sprays 12 to treat the gaseous effluent and reduce pollutant charges to the atmosphere. The gaseous effluents in the chimney 14 may be sprayed with water in line 45 which is recycled through washing circuit 47. The washed particulates in the gaseous stream are returned to the impinger tank 10 and then through a line 48 back to the holding tank 1 for recycling.

A mixing pump 13 is provided for recirculating the product slurry in the product tank 9 through circuit 46 for suitably mixing and also for discharging the mixed product through a line 50 for sale as recycled drilling mud. The circuit 46 enters line 40 before the fines in line 40 reach tank 9 for washing the fines from the gases in line 40. Therefore, the present apparatus not only reclaims valuable constituents from spent drilling fluids thereby reducing the costly disposal expenditures, but reprocesses the entire drilling fluid for making it pollution free and ecologically safe. Furthermore, the apparatus utilizes the oil in the spent drilling muds to provide fuel for treating the drilling fluids. While the apparatus of FIG. 1 constitutes the preferred embodiment for providing a stationary system 20, mobile trailer type systems have also been designed and built for disposing of spent drilling fluids. However, in order to make such a mobile trailer system compact, the product tank 9 may be eliminated and the resulting residue is merely dumped. While such a system does not include the recycling system, it does provide an effective system for disposing of spent drilling fluids without polluting either the air or land.

The method of the present invention is apparent from the foregoing description of the preferred embodiment of the invention. However, the method comprises disposing of oil field wastes containing hydrocarbons by igniting the waste in a rotary kiln, burning the waste and using the hydrocarbons in the waste as fuel until the wastes are dried, and removing the dried wastes from the kiln. The method further comprehends inserting fuel and air into the kiln for starting and aiding combustion of the wastes, separating the heavier components by gravity and removing the light weight fine dried components and gases from the kiln by suction. The method further comprehends separating the dry fines from the effluent gas and cleaning the gas prior to exhaust to the atmosphere. The method further comprehends mixing the separated dry more valuable fines with additional components for recycling and providing a usable product. The method also comprehends placing the spent drilling fluid into the upper end of a downwardly directed rotating kiln and inserting fuel and oil into the kiln at the same end of the kiln in which the drilling fluid is placed for starting and aiding combustion of the fluid, igniting and burning the hydrocarbons in the fluid in the kiln until the drilling fluid is dried, separating the high weight components from the lighter fines by gravity from the kiln and removing the light weight more valuable fine components from the kiln by suction.

It will be understood that while the foregoing description of the presently preferred embodiments of the invention have been embodiment of the invention has been given for the purpose of disclosure, numerous changes in the details of construction and arrangement of parts and steps of the process will be readily apparent to those skilled in the art. All such changes are encompassed within the spirit of the invention and the scope of the appended claims.

What is claimed is:

1. An apparatus for recycling drilling fluids containing barite and hydrocarbons comprising:

(a) a rotary kiln having a first end higher than a second end whereby drilling fluids rotating therein will flow from the first to the second end, said kiln having an inlet at the first end for receiving said drilling fluids;

(b) a furnace connected to the first end of the kiln for supplying fire to the kiln for aiding in burning the combustible components of said drilling fluids in the kiln;

(c) a fuel and pressurized air inlet connected to the furnace;

(d) an outlet at the second end of the kiln for removing the dried waste;

(e) means connected to the outlet for removing high weight dried waste from the kiln by gravity;

(f) a suction pump connected to the outlet for removing the dried low weight wastes including barite from the kiln by suction;

(g) a product mixing container connected to the downstream side of the suction means for mixing additional components with the barite for recycling the barite into new drilling fluid;

(h) means connected to the product mixing container for receiving gasses from the mixing container; and (i) means for cleaning the gasses prior to exhaust to the atmosphere.

2. The apparatus of claim 1 including means connected to the cleaning means for returning the products cleaned from the gasses to the kiln.

3. The apparatus of claim 1 including pump means connected to the mixing container for pumping the new drilling fluid into the downstream side of the suction pump and upstream of the mixing container for washing the low weight wastes from any gasses.

4. Apparatus for treating wastes containing carbonaceous materials comprising:

(a) a rotary kiln having a first end higher than a second end whereby material rotating therein will flow from the first to the second end, said kiln having an inlet at the first end;

(b) means for injecting burning fuel and air into said first end of the kiln and cause subsantially complete combustion of all carbonaceous materials in said wastes and leaving only dry solid non-combustible residue and gasses;

(c) outlet means at the second end of the kiln;

(d) separating means connected to said outlet means for separating heavier solid materials exiting said kiln from lighter solid materials exiting said kiln, said separating means including suction means for entraining said lighter materials in air and gasses exhausted from said kiln while permitting heavier solid materials to separate therefrom by gravity; and (e) means downstream from said suction means for separating said lighter solid materials from said gasses.

5. Apparatus as defined in claim 4 wherein said means downstream from said suction means comprises a tank of liquid through which the gasses containing said lighter solid materials are circulated to remove said lighter solid materials from said gasses.

* * * * *